US006037111A

United States Patent [19]

Haye et al.

[11] Patent Number: 6,037,111

[45] Date of Patent: Mar. 14, 2000

[54] LITHIUM AND MAGNESIUM ION FREE COLOR DEVELOPING COMPOSITION AND METHOD OF PHOTOPROCESSING

[75] Inventors: Shirleyanne E. Haye, Rochester; Janet M. Huston, Webster, both of N.Y.

[73] Assignee: Eastman Kodak Company, Rochester, N.Y.

[21] Appl. No.: 09/187,920

[22] Filed: Nov. 6, 1998

[51] Int. Cl.[7] ..... G03C 7/413

[52] U.S. Cl. ..... 430/491; 430/490

[58] Field of Search ..... 430/490, 491

[56] References Cited

U.S. PATENT DOCUMENTS

| | | | |
|---|---|---|---|
| 3,839,045 | 10/1974 | Brown | 430/467 |
| 3,994,730 | 11/1976 | Frank et al. | 430/467 |
| 4,172,728 | 10/1979 | Sincius et al. | 430/268 |
| 4,264,716 | 4/1981 | Vincent et al. | 430/380 |
| 4,330,616 | 5/1982 | Kurematsu et al. | 430/376 |
| 4,482,626 | 11/1984 | Twist et al. | 430/380 |
| 4,588,677 | 5/1986 | Ishikawa et al. | 430/387 |
| 4,596,764 | 6/1986 | Ishimaru | 430/393 |
| 4,693,956 | 9/1987 | Marchesano | 430/264 |
| 4,835,092 | 5/1989 | Ishikawa et al. | 430/380 |
| 4,837,132 | 6/1989 | Fujimoto et al. | 430/380 |
| 4,853,318 | 8/1989 | Fujita et al. | 430/380 |
| 4,873,180 | 10/1989 | Marchesano et al. | 430/491 |
| 4,892,804 | 1/1990 | Vincent et al. | 430/380 |
| 4,906,554 | 3/1990 | Ishikawa et al. | 430/467 |
| 4,975,357 | 12/1990 | Buongiorne et al. | 430/434 |
| 5,053,322 | 10/1991 | Shiba et al. | 430/491 |
| 5,094,937 | 3/1992 | Morimoto | 430/491 |
| 5,418,117 | 5/1995 | Marsden | 430/373 |

OTHER PUBLICATIONS

Research Disclosure Dec. 1979 #18837 "Use of sequestering agents in black and white photographic developers", Purol & Vincent.

Research Disclosure, Jun. 1975, #13410, "Photographic color developers containing mixtures of sequestering agents", O'connor.

*Primary Examiner*—Hoa Van Le

*Attorney, Agent, or Firm*—J. Lanny Tucker

[57] ABSTRACT

A photographic color developing composition includes a color developing agent, an organic antioxidant and at least 0.0005 mol/l of a polyaminopolyphosphonic acid calcium ion sequestering agent that has at least four phosphonic acid (or salt) groups. In addition, the total concentration of lithium and magnesium ions is less than 0.0001 mol/l. This composition can be in working strength or concentrated form (including solids), and has improved stability and reduced precipitates, and in some cases, provides improved yellow dye density.

21 Claims, 2 Drawing Sheets

LITHIUM AND MAGNESIUM ION FREE COLOR DEVELOPING COMPOSITION AND METHOD OF PHOTOPROCESSING

FIELD OF THE INVENTION

The present invention relates to photographic color developing compositions and to their use in the processing of color photographic silver halide materials. More specifically, it relates to photographic color developing compositions containing certain polyphosphonic acid calcium ion sequestering agents. These compositions and methods are useful in the field of photography.

BACKGROUND OF THE INVENTION

Photographic color developing compositions are used to process color photographic materials such as color photographic films and papers to provide the desired color images. Such compositions generally contain color developing agents, for example 4-amino-3-methyl-N-(β-methane sulfonamidoethyl)aniline, as reducing agents to react with suitable color forming couplers to form the desired dyes. However, such color developing agents are susceptible to oxidation by dissolved oxygen. Therefore, an antioxidant is conventionally included in the color developer compositions to preserve the oxidation state of the color developing agent and thereby maintain useful color developer activity.

Color developing compositions also tend to include various metal ions, some of which can negatively affect the color developing agent by rendering it more unstable, and that can cause the formation of undesirable precipitates such as calcium precipitates. Thus, it has been common in recent decades to include sequestering agents to stabilize the compositions against precipitation of metal salts or hydroxides and against undesired decomposition reactions, such as the decomposition of hydroxylamine antioxidants to generate amines A variety of metal ion sequestering agents have been proposed for this purpose, including polyhydroxy compounds as described in U.S. Pat. No. 4,975,357 (Buongiorne et al), aminopolycarboxylic acids as described for example in U.S. Pat. No. 4,835,092 (Ishikawa et al), U.S. Pat. No. 4,837,132 (Fujimoto et al) and U.S. Pat. No. 4,906,554 (Ishikawa et al).

In addition, amino-N,N-dimethylenephosphonic acids, aminodiphosphonic acids, N-acylaminodiphosphonic acids, hydroxyalkylidene-diphosphonic acids and other polyphosphonic acids (including diethylenetriamine pentamethylenephosphonic acid) are described in U.S. Pat. No. 4,873,180 (Marchesano et al), U.S. Pat. No. 4,892,804 (Vincent et al) and U.S. Pat. No. 5,418,117 (Marsden) as useful sequestering agents in color developing compositions. However, as this art points out, such compounds are generally used in combination with lithium salts (such as lithium sulfate or a lithium salt of a sulfonated polystyrene) that provide lithium ions to control the formation of calcium precipitates with such sequestering agents (see U.S. Pat. No. 3,839,045 of Brown). In other instances, magnesium salts are added for the same purpose. Thus, the additional metal ions are used to solubilize the sequestering agent-calcium ion complex. One very common sequestering agent of this type that is used with lithium or magnesium ions is 1-hydroxyethylidene-1,1-diphosphonic acid that is described in U.S. Pat. No. 4,330,616 (Kurematsu et al). Without the lithium and/or magnesium ions, calcium sludge is often formed that requires additional maintenance and disposal.

However, if the level of calcium ion becomes too high, as may be the case with water in some locations, even the presence of lithium or magnesium ions will not prevent the formation of precipitates. Thus, there is a need to avoid the use of such sequestering agents, with or without lithium or magnesium ions. There is continuing efforts in the industry to provide improved and lower cost color developing compositions with improved stability and reduced precipitates.

SUMMARY OF THE INVENTION

The problems noted above are overcome with a photographic color developing composition comprising:

a) at least 0.005 mol/l of a color developing agent, b) at least 0.005 mol/l of an organic antioxidant, and c) at least 0.0005 mol/l of a polyaminopolyphosphonic acid calcium ion sequestering agent that has at least four phosphonic acid groups, wherein the concentration of lithium and magnesium ions is a total of less than 0.0001 mol/l.

This invention also provides a single-part color developing concentrate comprising:

a) at least 0.05 mol/l of a color developing agent, b) at least 0.05 mol/l of an organic antioxidant, and c) at least 0.005 mol/l of a polyaminopolyphosphonic acid calcium ion sequestering agent that has at least four phosphonic acid groups, wherein the concentration of lithium and magnesium ions is a total of less than 0.001 mol/l.

Further, the present invention provides a method of providing a photographic image comprising:

A) color developing an imagewise exposed color photographic silver halide element for less than 120 seconds, with the color developing composition described above, and B) desilvering the color developed color photographic silver halide element.

The color developing composition of this invention can be provided as part of a kit that includes one or more other photoprocessing compositions, such as a bleach-fixing composition, a bleaching composition, a fixing composition, or a final rinse or a stabilizing composition.

The color developing compositions of this invention are less likely to have calcium ion precipitates because of the particular calcium ion sequestering agents that are included. Advantageously, these sequestering agents do not require the presence of lithium or magnesium ions, thereby simplifying the composition and reducing costs. Moreover, the particular sequestering agents provide improved stability of the color developing agent and organic antioxidant that are critical to the color developing composition. Unexpectedly, it was also found that with at least some photographic color papers, the presence of the sequestering agents improves yellow dye density in the resulting image.

DETAILED DESCRIPTION OF THE INVENTION

Figure 1:
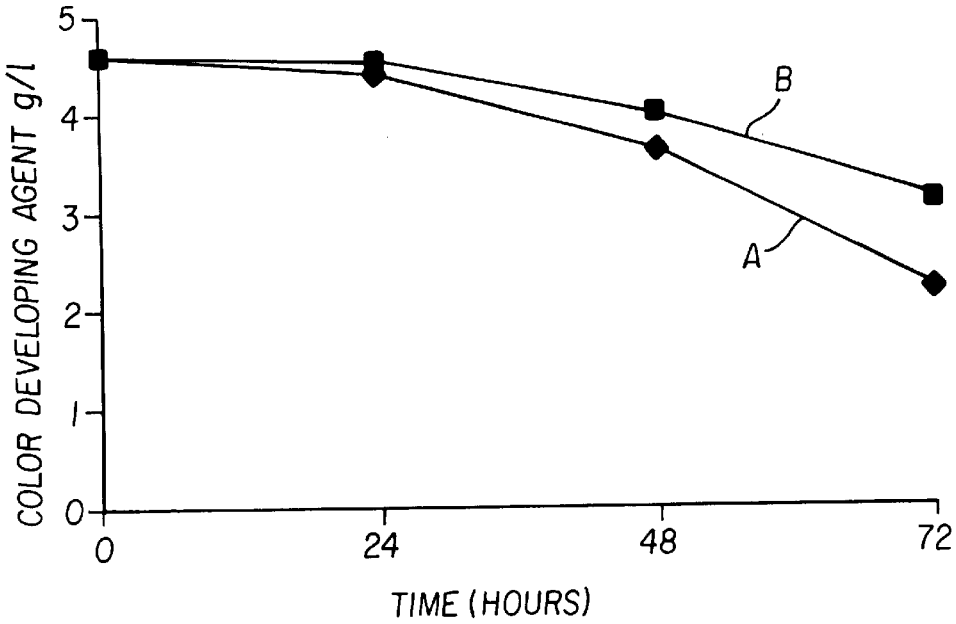
FIG. 1 is a graphical representation of the color developing agent stability over time using compared color developing compositions as described in Example 2 below.

The color developing compositions of this invention include one more calcium ion sequestering agents that are polyaminopolyphosphonic acids (or salts thereof) that have at least four phosphonic acid (or salt) groups. Preferably, the sequestering agents have at least five phosphonic acid (or salt) groups. Suitable salts include ammonium, and alkali metal salts.

Preferred sequestering agents useful in this invention can be represented by Structure I:

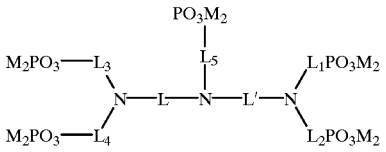

wherein L, L', $L_1$, $L_2$, $L_3$, $L_4$ and $L_5$ are independently substituted or unsubstituted divalent aliphatic linking groups, each independently having 1 to 4 carbon, oxygen, sulfur or nitrogen atoms in the linking group chain. Preferably, these substituted or unsubstituted divalent linking groups have 1 to 4 carbon atoms in the linking group chain (such as substituted or unsubstituted branched or linear alkylene groups). More preferably, the divalent linking groups are independently substituted or unsubstituted methylene or ethylene. Most preferably, L and L' are each substituted or unsubstituted ethylene (preferably unsubstituted), and each of the other linking groups is an unsubstituted methylene group. M is hydrogen or a monovalent cation (such as ammonium ion or an alkali metal salt).

The noted divalent groups can be substituted with any substituent that does not interfere with the desired performance of the sequestering agent, or with the photochemical properties of the color developing compositions. Such substituents include, but are not limited to, hydroxy, sulfo, carboxy, halo, lower alkoxy (1 to 3 carbon atoms) or amino.

Mixtures of the sequestering agents can be used if desired. A particularly useful sequestering agent is diethylenetriaminepentamethylene-phosphosphonic acid or an alkali metal salt thereof (available as DEQUEST™ 2066 from Solutia Co.).

The concentration of sequestering agent in the color developing composition of this invention is generally at least 0.0005 mol/l and preferably at least 0.0001 mol/l, and generally up to 0.05 mol/l and preferably up to 0.02 mol/l. In concentrated forms of the composition, the amounts of the sequestering agent can be 10 times more (at least 0.005 mol/l).

It is also possible to include other metal ion sequestering agents (for example, for iron, copper or manganese sequestration) in the color developing composition as long as the other conditions of the invention are met. Such metal ion sequestering agents are usually polycarboxylic acids, aminopolycarboxylic acids or polyaminopolycarboxylic acids that are known in the art.

No lithium or magnesium ions are intentionally added to the color developing compositions of this invention. Depending upon the concentrations of such ions in water used to make up processing solutions, or carried over from previous processing baths, the total concentration (that is, the sum) of these ions remains very low, that is less than 0.0001 mol/l in the compositions, and preferably a total of less than 0.00001 mol/l. In the concentrated color developing compositions, the sum total of these ions may be as much as 10 times higher.

In order to protect the color developing agents from oxidation, one or more organic antioxidants are included in the color developing compositions. Many classes of useful organic antioxidants are known, including but not limited to, hydroxylamine (and derivatives thereof), hydrazines, hydrazides, amino acids, ascorbic acid (and derivatives thereof), hydroxamic acids, aminoketones, mono- and polysaccharides, mono- and polyamines, quaternary ammonium salts, nitroxy radicals, alcohols, and oximes. Also useful as antioxidants are 1,4-cyclohexadiones as described in copending and commonly assigned U.S. Ser. No. 09/123976 (filed Jul. 29, 1998 by Qiao and McGarry). Mixtures of compounds from the same or different classes of antioxidants can also be used if desired.

Especially useful antioxidants are hydroxylamine derivatives as described for example, in U.S. Pat. No. 4,892,804, U.S. Pat. No. 4,876,174, U.S. Pat. No. 5,354,646, and U.S. Pat. No. 5,660,974, all noted above, and U.S. Pat. No. 5,646,327 (Burns et al), the disclosures of which are all incorporated herein by reference. Many of these antioxidants are mono- and dialkylhydroxylamines having one or more substituents on one or both alkyl groups. Particularly useful alkyl substituents include sulfo, carboxy, amino, sulfonamido, carbonamido, phosphono, hydroxy and other solubilizing substituents.

More preferably, the noted hydroxylamine derivatives can be mono- or dialkylhydroxylamines having one or more hydroxy substituents on the one or more alkyl groups. Representative compounds of this type are described for example in U.S. Pat. No. 5,709,982 (Marrese et al), incorporated herein by reference, as having the structure I:

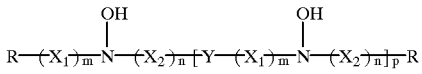

wherein R is hydrogen, a substituted or unsubstituted alkyl group of 1 to 10 carbon atoms (preferably 1 to 7 carbon atoms, branched or linear), a substituted or unsubstituted haloalkyl groups of 1 to 10 carbon atoms (preferably 1 to 3 carbon atoms, and 1 or 2 chloro atoms), a substituted or unsubstituted hydroxyalkyl group of 1 to 10 carbon atoms (preferably 1 to 3 carbon atoms), a substituted or unsubstituted cycloalkyl group of 5 to 10 carbon atoms (preferably cyclohexyl), or a substituted or unsubstituted aryl group having 6 to 10 carbon atoms in the aromatic nucleus (preferably phenyl).

$X_1$ is —C(OH)$R_2$CH$R_1$— and $X_2$ is —CH$R_1$C(OH)$R_2$— wherein $R_1$ and $R_2$ are independently hydrogen, hydroxy, a substituted or unsubstituted alkyl group or 1 or 2 carbon atoms, a substituted or unsubstituted hydroxyalkyl group of 1 or 2 carbon atoms, or $R_1$ and $R_2$ together represent the carbon atoms necessary to complete a substituted or unsubstituted 5- to 8-membered saturated or unsaturated carbocyclic ring structure.

Y is a substituted or unsubstituted alkylene group having at least 4 carbon atoms, and has an even number of carbon atoms in the chain, or Y is a substituted or unsubstituted divalent aliphatic group having an even total number of carbon and oxygen atoms in the chain, provided that the aliphatic group has a least 4 atoms in the chain.

The substituents on such radicals defining the organic antioxidant can be any group that does not interfere with the performance of the compound or the photochemical performance of the color developing composition.

Also in Structure I, m, n and p are independently 0 or 1. Preferably, each of m and n is 1, and p is 0.

Specific disubstituted hydroxylamine antioxidants include, but are not limited to: N,N-bis(2,3-dihydroxypropyl)hydroxylamine, N,N-bis(2-methyl-2,3-dihydroxypropyl)hydroxylamine and N,N-bis(1-hydroxymethyl-2-hydroxy-3-phenylpropyl)hydroxylamine. The first compound is preferred.

Many of the noted organic antioxidants are either commercially available or prepared using starting materials and procedures described in the references noted above in describing hydroxylamines.

The organic antioxidant is included in the color developing composition of this invention in an amount of at least 0.005 mol/l, and preferably at least 0.02 mol/l. Generally, the composition has up to 2 mol/l, and preferably up to 1 mol/l.

When the color developing composition of this invention is in an aqueous form, its pH is generally from about 9 to about 13 (preferably from about 9 to about 12), as provided by the addition of one or more weak or strong bases (such as a hydroxide) or buffers in amounts readily known in the art. Particularly useful buffers include, but are not limited to, carbonates, borates, tetraborates, phosphates, glycine salts, leucine salts, valine salts, proline salts, alanine salts, aminobutyric acid salts, lysine salts, guanine salts and hydroxybenzoates.

The developing compositions of this invention include one or more color developing agents, of which there are hundreds of possibilities. Preferably, the developing agent is a color developing agent. Such materials include, but are not limited to, aminophenols, p-phenylenediamines (especially N,N-dialkyl-p-phenylenediamines) and others which are well known in the art, such as EP 0 434 097A1 (published Jun. 26, 1991) and EP 0 530 921A1 (published Mar. 10, 1993). It may be useful for the color developing agents to have one or more water-solubilizing groups as are known in the art. Further details of such materials are provided in *Research Disclosure,* publication 38957, pages 592–639 (September 1996). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*".

Preferred color developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 4-(N-ethyl-N-β-hydroxyethylamino)-2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2 -methanesulfonylaminoethyl)-2-methylphenylenediamine sesquisulfate, and others readily apparent to one skilled in the art.

The color developing agent is generally present in the developing composition generally in an amount of at least 0.005 mol/l, and preferably at least 0.02 mol/l. Generally, such compounds are present in an amount of up to 1 mol/l and preferably up to 0.5 mol/l.

The color developing compositions can be easily prepared by mixing a suitable color developing agent, organic antioxidant and calcium ion sequestering agent as described above, in a suitable aqueous solution, or dry powder mixtures. Water can be added to resulting solutions to provide the desired concentrations of the components, and the pH can be adjusted as noted above.

The developing compositions can also include one or more of a variety of other addenda which are commonly used in such compositions, including alkali metal halides (such as potassium chloride, potassium bromide, sodium bromide and sodium iodide), buffers (as noted above), inorganic preservatives (such as sulfites), antifoggants, development accelerators, optical brightening agent (such as a triazinylstilbene), wetting agents, stain reducing agents, surfactants, defoaming agents, and water-soluble or water-dispersible color couplers, as would be readily understood by one skilled in the art [see for example, *Research Disclosure,* noted above, U.S. Pat. No. 5,738,979 (noted above) and U.S. Pat. No. 4,814,260 of Koboshi et al]. The amounts of such additives are well known in the art also. Preferred color developing compositions are described below in Examples 1, 5 and 6.

The color developing compositions of this invention are preferably formulated and used as an aqueous solution, either as the working strength solution or as a replenishing solution. However, as is known in the art, photographic developing compositions can also be formulated as used as dry tablets. The technology for this embodiment is readily known in the art, such as U.S. Pat. No. 5,362,610 (Yoshimoto), U.S. Pat. No. 5,376,509 (Yoshimoto et al) and EP-A-0 611 986A1 (published Aug. 24, 1994).

The color developing compositions of this invention have utility to provide color development in an imagewise exposed color photographic silver halide element comprising a support and one or more silver halide emulsion layers containing an imagewise distribution of developable silver halide emulsion grains. A wide variety of types of photographic elements (both color films and papers, and color motion picture films and prints) containing various types of emulsions can be processed using the present invention, the types of elements being well known in the art (see *Research Disclosure,* noted above). In particular, the invention can be used to process photographic color papers of all types of emulsions, including so-called "high chloride" and "low chloride" type emulsions, and so-called tabular grain emulsions as well. The color developing composition can also be used in color reversal processing of color reversal films and papers.

The present invention is particularly useful to process high chloride (greater than 70 mole % chloride and preferably greater than 90 mole % chloride, based on total silver) emulsions in photographic color papers. Such color papers can have any useful amount of silver coated in the one or more emulsions layers, and in some embodiments, low silver (that is, less than about 0.7 g silver/$m^2$) elements are processed with the present invention. The layers of the photographic elements can have any useful binder material or vehicle as it known in the art, including various gelatins and other colloidal materials.

Color development of an imagewise exposed photographic silver halide element is carried out by contacting the element with the color developing composition of this invention under suitable time and temperature conditions, in suitable processing equipment, to produce the desired color and silver image. Additional processing steps can then be carried out using conventional procedures, including but not limited to, one or more development stop, bleaching, fixing, bleach/fixing, washing (or rinsing), stabilizing and drying steps, in any particular desired order as would be known in the art. Useful processing steps, conditions and materials useful therefor are well known for the various processing protocols including the conventional Process C-41 processing of color negative films, Process RA-4 for processing color papers and Process E-6 for processing color reversal films (see for example, *Research Disclosure*).

The photographic color elements processed in the practice of this invention can be single or multilayer color elements.

Multilayer color elements typically contain dye image-forming units sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be included on the backside of conventional supports.

Considerably more details of the element structure and components, and suitable methods of processing various types of elements are described in *Research Disclosure,* noted above. Included within such teachings in the art is the use of various classes of cyan, yellow and magenta dye forming color couplers that can be used with the present invention (including pyrazolone and pyrazolotriazole magenta dye forming couplers). In addition, the present invention can be used to process color photographic papers having pigmented resin-coated paper supports which are prepared with the usual internal and external sizing agents (including alkylketene dimers and higher fatty acids), strengthening agents and other known paper additives and coatings.

The elements are typically exposed to suitable radiation to form a latent image and then processed to form a visible dye and silver image. Processing then includes the step of color development in the presence of a color developing agent to reduce developable silver halide and to oxidize the color developing agent. Oxidized color developing agent in turn reacts with a color-forming coupler to yield a dye.

The color developing composition of this invention can also be used in what are known as redox amplification processes, as described for example, in U.S. Pat. No. 5,723,268 (Fyson) and U.S. Pat. No. 5,702,873 (Twist).

Processing according to the present invention can be carried out using conventional deep tanks holding processing solutions. Alternatively, it can be carried out using what is known in the art as "low volume thin tank" processing systems, or LVTT, which have either a rack and tank or automatic tray design. Such processing methods and equipment are described, for example, in U.S. Pat. No. 5,436,118 (Carli et al) and publications noted therein.

Color development is generally followed by a bleaching and fixing steps or a bleach/fixing step using a suitable silver bleaching and fixing agents. Numerous bleaching agents are known in the art, including hydrogen peroxide and other peracid compounds, persulfates, periodates and ferric ion salts or complexes with polycarboxylic acid chelating ligands. Particularly useful chelating ligands include conventional polyaminopolycarboxylic acids including ethylenediaminetetraacetic acid and others described in Research Disclosure, noted above, U.S. Pat. No. 5,582,958 (Buchanan et al) and U.S. Pat. No. 5,753,423 (Buongiorne et al). Biodegradable chelating ligands are also desirable because the impact on the environment is reduced. Useful biodegradable chelating ligands include, but are not limited to, iminodiacetic acid or an alkyliminodiacetic acid (such as methyliminodiacetic acid), ethylenediaminedisuccinic acid and similar compounds as described in EP-A-0 532,003, and ethylenediamine monosuccinic acid and similar compounds as described in U.S. Pat. No. 5,691,120 (Wilson et al). Conventional fixing agents, such as thiosulfate and thiocyanates, can be used for the steps including fixing.

The processing time and temperature used for each processing step of the present invention are generally those conventionally used in the art. For example, color development is generally carried out at a temperature of from about 20 to about 60° C. The overall color development time can be up to 10 minutes, and preferably less than 450 seconds. Overall development times of up to 50 seconds are generally used for processing photographic color papers, and preferably less than 35 seconds is used.

The color developing composition of this invention can be formulated as a concentrated single-part, ready-to-use aqueous color developing composition that can be diluted appropriately during or prior to use. In addition, it can be used as a processing tank or replenisher solution, or both. A preferred single-part color developing composition is described and claimed in copending and commonly assigned U.S. Ser. No. 09/132,200, filed Aug. 11, 1998 by Darmon et al. These compositions include an organic solvent such as a glycol, and are free of sulfates.

In one embodiment of this invention, the color developing composition is one chemical formulation (dry or liquid) in a photographic processing chemical kit that can include one or more other photographic processing compositions (dry or liquid) including, but not limited to, a photographic bleaching composition, a photographic bleach/fixing composition, a photographic fixing composition, and a photographic stabilizing or a photographic final rinse composition. Such additional compositions can be formulated in concentrated or working strength solutions, or provided in dry form (for example, powder, granules or tablet). Other processing compositions that can be included in such kits for color reversal processing are black-and-white development compositions, reversal compositions, conditioning compositions, prebleach compositions, acidic stop compositions, and others readily apparent to one skilled in the photographic art. The processing kits can also include various processing equipment, metering devices, processing instructions, silver recovery devices and other articles that would be readily apparent to one skilled in the art.

The following examples are provided to illustrate the practice of this invention and not to limit it in any way. Unless otherwise indicated, percentages are by weight.

EXAMPLE 1

Color Developing Composition

Several color developing compositions of the prior art were compared to a color developing composition of the present invention. These compositions are shown below in TABLE I:

TABLE I

| CHEMICAL COMPONENT | CONTROL A | CONTROL B | CONTROL C | CONTROL D | INVENTION |
|---|---|---|---|---|---|
| Triethanolamine (85%) | 6.74 ml | 6.74 ml | 6.74 ml | 6.74 ml | 6.74 ml |
| VERSA TL-73 (30%) Polystyrene sulfonate (National Starch) | 0.25 ml | 0.25 ml | 0.25 ml | 0.25 ml | 0.25 ml |
| N,N-diethylhydroxylamine antioxidant | 5.0 ml | 5.0 ml | 5.0 ml | 5.0 ml | 5.0 ml |

TABLE I-continued

| CHEMICAL COMPONENT | CONTROL A | CONTROL B | CONTROL C | CONTROL D | INVENTION |
|---|---|---|---|---|---|
| Substituted triazinylstilbene optical brightener | 1 g | 1 g | 1 g | 1 g | 1 g |
| Lithium sulfate | 0 | 0 | 0 | 0 | 0 |
| 1-hydroxyethylidene-1,1-diphosphonic acid (60%) calcium ion sequestering agent | 0 | 0.6 g | 1.0 g | 0 | 0 |
| Diethylenetriaminepentaacetic acid, pentasodium salt (40%) | 0 | 0 | 0 | 4 ml | 0 |
| Diethylenetriaminepentamethylene-phosphonic acid, heptasodium salt (30%) calcium ion sequestering agent | 0 | 0 | 0 | 0 | 8 ml (0.004 mol/l) |
| Potassium chloride | 6.4 g | 6.4 g | 6.4 g | 6.4 g | 6.4 g |
| Potassium bromide | 0.028 g | 0.028 g | 0.028 g | 0.028 g | 0.028 g |
| Potassium carbonate | 25 g | 25 g | 25 g | 25 g | 25 g |
| KODAK Color Developing Agent CD-3 | 4.35 g | 4.35 g | 4.35 g | 4.35 g | 4.35 g |
| Water to make | 1 liter | 1 liter | 1 liter | 1 liter | 1 liter |
| pH | 10.10 ± 0.05 | 10.10 ± 0.05 | 10.10 ± 0.05 | 10.10 ± 0.05 | 10.10 ± 0.05 |

Controls A–D and the Invention compositions contained no lithium ions. However, additional compositions were similarly prepared corresponding to Controls A–D but also containing 2 g of lithium sulfate and are identified herein as Controls A'–D'. A composition identified as Control E' contained a formulation similar to the Invention, but including 2 g of lithium sulfate.

Each of these color developing compositions was titrated to a permanent turbidity with a solution having either 0. 25 mol/l of 0.5 mol/l or calcium chloride at 38° C. The results, shown in TABLE II below, indicate that the Control A and A' compositions having no calcium ion sequestering agent, complexed with 80 and 130 ppm of calcium ions. When sequestering agents outside of this invention are included (Controls B–D and B'–D'), calcium ion sequestration improved. The presence of lithium ions improved calcium ion sequestration in some compositions (Controls A' and D'), but not in others (Controls B' and C'). However, the Invention composition provided the highest calcium ion sequestration (490 ppm) without the presence of lithium ions.

TABLE II

| COMPOSITION | CALCIUM ION COMPLEXATION (ppm) |
|---|---|
| Control A | 80 |
| Control A' | 130 |
| Control B | 225 |
| Control B' | 195 |
| Control C | 365 |
| Control C' | 315 |
| Control D | 230 |
| Control D' | 255 |
| Control E' | 455 |
| Invention | 490 |

EXAMPLE 2

Stability Under Aeration Tests

Figure 2:
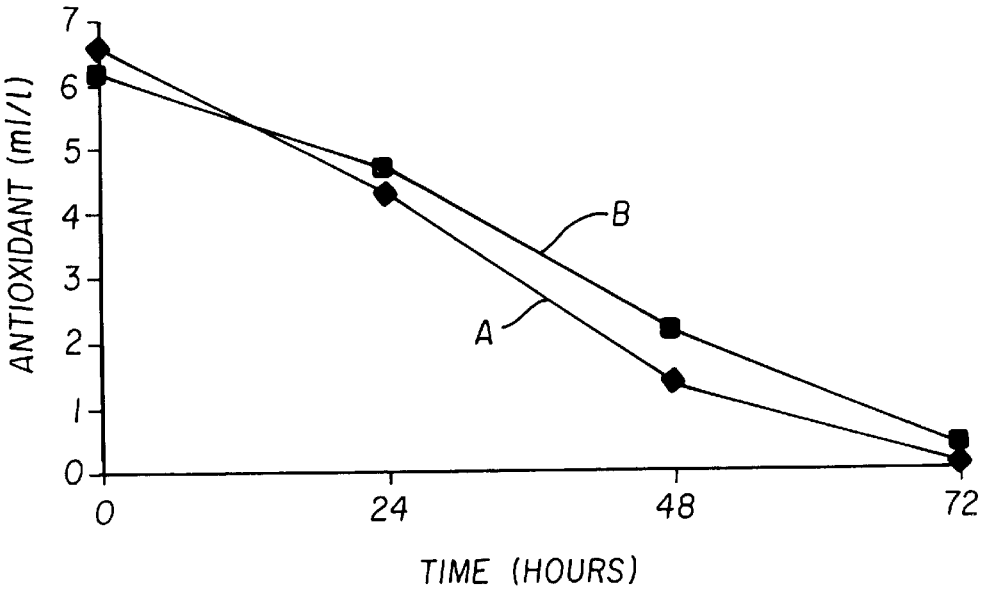
FIG. 2 is a graphical representation of the organic antioxidant stability over time using compared color developing compositions as described in Example 2 below.

The Invention and Control B' compositions of Example 1 were evaluated for the stability of the color developing agent and antioxidant. The amounts of color developing agent and antioxidant were measured during a standard accelerated aeration test in which air was bubbled into 1 liter of the composition at an air flow rate of about 325 ml/min at 25° C. FIGS. 1 and 2 show the results of loss in color developing agent and antioxidant during aeration, respectively. For both FIGURES, the curves labeled "A" represent the Control B' composition, and Curve "B" represents the Invention. The composition of this invention exhibited improved color developing agent and antioxidant stability. TABLE III below shows the same information as % of original color developing agent or antioxidant remaining after aeration time.

TABLE III

| TIME (days) | CONTROL B' COLOR DEVELOPING AGENT | INVENTION COLOR DEVELOPING AGENT | CONTROL B' ANTIOXIDANT | INVENTION ANTIOXIDANT |
|---|---|---|---|---|
| 0 | 100 | 100 | 100 | 100 |
| 24 | 95.7 | 97.8 | 65 | 76 |
| 48 | 78.3 | 87 | 21.2 | 35.5 |
| 72 | 47.8 | 67.4 | 1.5 | 6.45 |

EXAMPLE 3

Stability in the Presence of Various Metal Ions

Additional experiments were carried out to show that the compositions of the invention have increased stability with the required calcium ion sequestering agents when other metal ions are added. It appears that such calcium ion sequestering agents also complex with iron, manganese and copper ions that would usually destabilize the compositions. To determine these results, keeping studies were performed on several color developing compositions like those described in Example 1, except for the amount and type of calcium ion sequestering agent and the level of metal ions. TABLE IV below shows the results of the levels of color developing agent (KODAK Color Developing Agent CD-3) and N,N-diethylhydroxylamine antioxidant when freshly prepared and after a 30-day (or 40-day) keeping test at room temperature in the presence of certain metal ions. The compositions of the present invention generally maintained color developing agent and antioxidant levels after keeping in the presence of the metal ions compared to the Control B' composition.

TABLE IV

| Color Developing Composition | Metal Ions Added (10 ppm) | Fresh: Color Developing Agent (g/l) | Fresh: Antioxidant (ml/l) | After 30 Days: Color Developing Agent (g/l) | After 30 Days: Antioxidant (ml/l) |
|---|---|---|---|---|---|
| Control B' | None | 4.3 | 4.5 | 4.3* | 3.3* |
| | Manganese | 4.4 | 4.0 | 4.3 | 3.8 |
| | Copper | 4.3 | 3.5 | 4.2 | 3.6 |
| | Iron | 4.3 | 4.0 | 4.2 | 3.9 |
| Invention (0.004 mol/l of sequestering agent) | None | 4.2 | 4.4 | 4.2* | 3.7* |
| | Manganese | 4.3 | 4.4 | 4.3 | 4.2 |
| | Copper | 4.4 | 4.4 | 4.3 | 4.3 |
| | Iron | 4.3 | 4.3 | 4.2 | 4.0 |
| Invention (0.002 mol/l of sequestering agent) | Manganese | 4.4 | 4.4 | 4.2 | 4.3 |
| | Copper | 4.4 | 4.4 | 4.2 | 4.2 |
| | Iron | 4.3 | 4.3 | 4.2 | 4.0 |

*Keeping results at 40 days.

EXAMPLE 4

Effects of Sequestering Agents on Sensitometry

Samples of KODAK EKTACOLOR EDGE 2 and KODAK EKTACOLOR EDGE V Color Papers and other known color papers were imagewise exposed, color developed using the Control B' and Example 1 color developing compositions, bleach-fixed and washed (using standard EKTACOLOR Process RA-4 bleach/fix and washing solutions), and evaluated for blue light sensitive layer Dmax densities. The processing steps were carried out using standard EKTACOLOR Process RA-4 temperature and times, except that color development times were varied.

Figure 3:
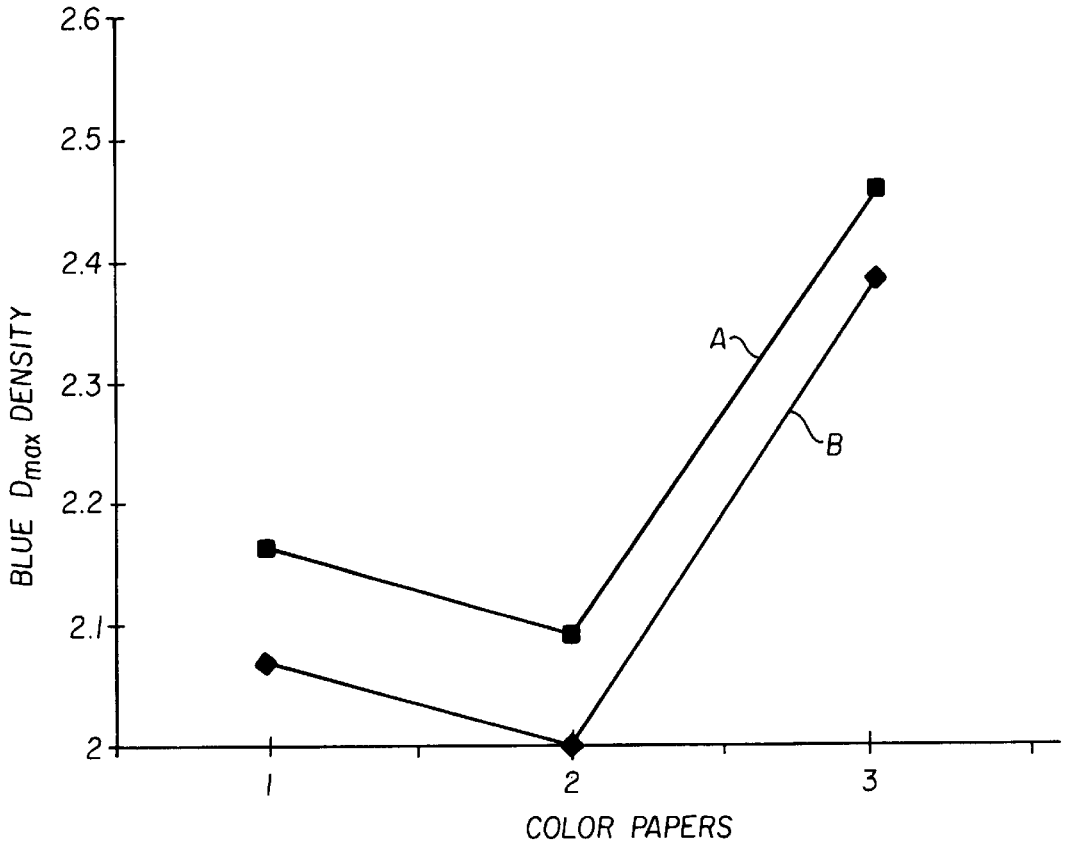
FIG. 3 is a graphical representation of blue densities ($D_{max}$) provided by samples of processed color paper as described in Example 4 below.

FIG. 3 shows the sensitometric results for the color paper samples. Curve A represents the present invention, and Curve B represents the use of the Control B composition. The tested color papers are identified as follows:

Color Paper 1: KODAK EKTACOLOR EDGE V Color Paper

Color Paper 2: KODAK EKTACOLOR EDGE 2 Color Paper

Color Paper 3: Color paper described in U.S. Pat. No. 5,830,631 (see the Example)

EXAMPLES 5 & 6

Alternative Color Developing Compositions

Other color developing compositions of this invention were prepared having the following formulations shown in TABLE V:

TABLE V

| CHEMICAL COMPONENT | Example 5 | Example 6 |
|---|---|---|
| Water | 800 ml | 792 ml |
| Triethanolamine (85%) | 6.74 ml | 6.74 ml |
| VERSA TL-73 (30%) polystyrene sulfonate (National Starch) | 0.25 ml | 0.25 ml |
| N-isopropyl-N-(2-ethyl-sulfonic acid)-hydroxylantine antioxidant | 9.5 g | 0 |
| N,N-(2,3-dihydroxypropyl)-hydroxylamine antioxidant | 0 | 15.9 g |
| Substituted triazinylstilbene optical brightener | 1 g | 1 g |
| Lithium sulfate | 2 g | 0 |

TABLE V-continued

| CHEMICAL COMPONENT | Example 5 | Example 6 |
|---|---|---|
| Diethylenetriaminepenta-methylene-phosphonic acid, heptasodium salt (30%) calcium ion sequestering agent | 0.002 or 0.004 mol/l | 0.002 or 0.004 mol/l |
| Potassium chloride | 6.4 g | 6.4 g |
| Potassium bromide | 0.028 g | 0.028 g |
| Potassium carbonate | 25 g | 25 g |
| KODAK Color Developing Agent CD-3 | 4.35 g | 4.35 g |
| Water to make | 1 liter | 1 liter |
| pH | 10.10 ± 0.05 | 10.10 ± 0.05 |

Both of these color developing compositions were successfully used to develop imagewise exposed photographic color papers.

The invention has been described in detail with particular reference to preferred embodiments thereof, but it will be understood that variations and modifications can be effected within the spirit and scope of the invention.

We claim:

1. A photographic color developing composition comprising:

a) at least 0.005 mol/l of a color developing agent, b) at least 0.005 mol/l of an organic antioxidant, and c) at least 0.0005 mol/l of a polyaminopolyphosphonic acid calcium ion sequestering agent that has at least five phosphonic acid groups, wherein the concentration of lithium and magnesium ions is a total of less than 0.0001 mol/l.

2. The composition of claim 1 wherein said calcium ion sequestering agent is present at a concentration of from about 0.0005 to about 0.05 mol/l.

3. The composition of claim 2 wherein said calcium ion sequestering agent is present at a concentration of from about 0.0001 to about 0.02 mol/l.

4. The composition of claim 1 wherein said calcium ion sequestering agent is represented by the Structure I:

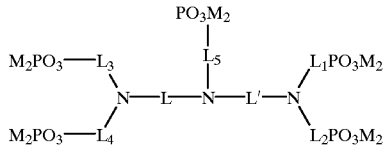

wherein L, L', $L_1$, $L_2$, $L_3$, $L_4$ and $L_5$ are independently divalent aliphatic linking groups independently having from 1 to 4 carbon, oxygen, sulfur or nitrogen atoms in the linking group chain, and M is hydrogen or a monovalent cation.

5. The composition of claim 4 wherein said divalent aliphatic linking groups independently have from 1 to 4 carbon atoms in the linking group chain.

6. The composition of claim 4 wherein $L_1$, $L_2$, $L_3$, $L_4$ and $L_5$ are unsubstituted methylene groups, and L and L' are independently ethylene groups.

7. The composition of claim 1 wherein said calcium ion sequestering agent is diethylenetriaminepentamethylenephosphonic acid or a salt thereof.

8. The composition of claim 1 wherein said color developing agent is present at a concentration of from about 0.005 to about 1 mol/l, and said organic antioxidant is present at a concentration of from about 0.005 to about 2 mol/l.

9. The composition of claim 1 wherein said organic antioxidant is a mono- or dialkylhydroxylamine.

10. The composition of claim 9 wherein said organic antioxidant has at least one sulfo, carboxy, hydroxy, amino, sulfonamido, carbonamido or phosphono group.

11. The composition of claim 9 wherein said organic antioxidant is represented by Structure II:

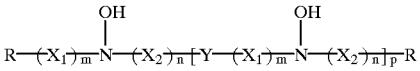

wherein R is hydrogen, an alkyl group, a haloalkyl group, a hydroxyalkyl group, a cycloalkyl group, or an aryl group, $X_1$ is —C(OH)$R_2$CH$R_1$—, $X_2$ is —CH$R_1$C(OH)$R_2$—, $R_1$ and $R_2$ are independently hydrogen, an alkyl group, hydroxy, or a hydroxyalkyl group, or $R_1$ and $R_2$ together represent the carbon atoms necessary to complete a 5- to 8-membered carbocyclic ring structure, Y is an alkylene group having at least 4 carbon atoms and an even number of carbon atoms in the chain, or Y is a divalent aliphatic group having at least 4 carbon or oxygen atoms in the chain and an even number of total atoms in the chain, and m, n and p are independently 0 or 1.

12. The composition of claim 11 wherein R is an alkyl group of 1 to 7 carbon atoms, a haloalkyl group of 1 to 3 carbon atoms and one or two chloro substituents, a hydroxyalkyl group of 1 to 3 carbon atoms, a cyclohexyl group or a phenyl group, $R_1$ and $R_2$ are independently an alkyl group of 1 to 2 carbon atoms or a hydroxyalkyl of 1 to 2 carbon atoms, and Y is an alkylene group of at least 4 carbon atoms and having an even total number of carbon atoms in the chain.

13. The composition of claim 11 wherein said organic antioxidant of Structure II is N,N-bis(2,3-dihydroxypropyl) hydroxylamine, N,N-bis(2-methyl-2,3-dihydroxypropyl) hydroxylamine or N,N-bis(1-hydroxymethyl-2-hydroxy-3-phenylpropyl)hydroxylamine.

14. The composition of claim 1 wherein said organic antioxidant is N,N-(2,3-dihydroxypropyl)hydroxylamine.

15. A single-part color developing concentrate comprising:

a) at least 0.05 mol/l of a color developing agent, b) at least 0.05 mol/l of an organic antioxidant, and c) at least 0.005 mol/l of a polyaminopolyphosphonic acid calcium ion sequestering agent that has at least five phosphonic acid groups, wherein the concentration of lithium and magnesium ions is a total of less than 0.001 mol/l.

16. A method of providing a photographic image comprising:

A) color developing an imagewise exposed color photographic silver halide element for less than 120 seconds, with the color developing composition of claim 1, and B) desilvering said color developed color photographic silver halide element.

17. The method of claim 16 wherein said silver halide element is a photographic color paper and color developing is carried out within 50 seconds.

18. The method of claim 17 wherein said photographic color paper has a total silver coverage of less than 0.7 $g/m^2$ and color development is carried out for less than 35 seconds.

19. A method of providing a color image from a photographic color paper comprising:

A) color developing an imagewise exposed photographic color paper using a color developing composition comprising:

a) at least 0.005 mol/l of a color developing agent, b) at least 0.005 mol/l of an organic antioxidant, and c) at least 0.0005 mol/l of a polyaminopolyphosphonic acid calcium ion sequestering agent that has at least five phosphonic acid groups, wherein the concentration of lithium or magnesium ions is a total of less than 0.0001 mol/l, and B) bleach/fixing said color developed color paper.

20. The method of claim 19 wherein said organic antioxidant is N,N-(2,3-dihydroxypropyl)hydroxylamine, and said calcium ion sequestering agent is diethylenetriaminepentamethylenephosphonic acid or an alkali metal salt thereof.

21. A photographic processing kit comprising:

a) a color developing composition comprising:

at least 0.005 mol/l of a color developing agent, at least 0.005 mol/l of an organic antioxidant, and at least 0.0005 mol/l of a polyaminopolyphosphonic acid calcium ion sequestering agent that has at least five phosphonic acid groups, wherein the concentration of lithium and magnesium ions is a total of less than 0.0001 mol/l, and b) any one of a photographic bleach/fixing composition, a photographic bleaching composition, a photographic fixing composition, a photographic stabilizing composition and a photographic final rinse composition.

* * * * *